US006887007B2

(12) United States Patent
Sorrell

(10) Patent No.: US 6,887,007 B2
(45) Date of Patent: May 3, 2005

(54) HAND-HELD BODY WASHING DEVICE

(76) Inventor: Roger Lynn Sorrell, 9804 Southview Ct., Raleigh, NC (US) 27604

( * ) Notice: Subject to any disclaimer, the term of this patent is extended or adjusted under 35 U.S.C. 154(b) by 37 days.

(21) Appl. No.: 10/165,149

(22) Filed: Jun. 7, 2002

(65) Prior Publication Data

US 2002/0150418 A1 Oct. 17, 2002

Related U.S. Application Data

(60) Continuation-in-part of application No. 10/074,164, filed on Feb. 12, 2002, now abandoned, which is a division of application No. 09/800,950, filed on Mar. 7, 2001, now Pat. No. 6,368,003.

(51) Int. Cl.[7] ..... B43K 5/00; B43M 11/06

(52) U.S. Cl. ..... 401/205; 401/183; 401/185

(58) Field of Search ..... 401/196, 201, 401/183, 184, 185, 186; 206/77.1; 383/117, 126; 215/258, 270, 294, 306, 355, 358, 362; 19/229.11, 229.12

(56) References Cited

U.S. PATENT DOCUMENTS

| | | | | | |
|---|---|---|---|---|---|
| 2,035,014 | A | | 3/1936 | Schaefer | |
| 3,717,068 | A | * | 2/1973 | Cochran et al. | 89/1.806 |
| 3,812,849 | A | | 5/1974 | Giunta | |
| 3,934,873 | A | * | 1/1976 | Griffin | 473/424 |
| 4,085,875 | A | * | 4/1978 | Campbell et al. | 294/158 |
| 4,874,102 | A | * | 10/1989 | Jessop et al. | 215/273 |
| 5,857,794 | A | * | 1/1999 | Chien | 401/201 |
| D405,925 | S | * | 2/1999 | Badillo | D28/63 |
| 5,944,032 | A | | 8/1999 | Masterson | |
| 5,983,435 | A | * | 11/1999 | Osborne | 15/209.1 |
| 6,015,242 | A | | 1/2000 | Gillis | |
| 6,039,491 | A | | 3/2000 | Badillo | |
| D452,591 | S | * | 12/2001 | Badillo | D28/63 |

* cited by examiner

*Primary Examiner*—David J. Walczak
(74) *Attorney, Agent, or Firm*—Coats & Bennett, P.L.L.C.

(57) ABSTRACT

A hand-held washing device comprises a scrubber and a fluid dispenser to contain a cleaning fluid such as liquid soap. The device is constructed of an mesh material bound together in a plurality of pleats. The fluid dispenser includes a fill opening and an outlet. A plug is sized to be removable mounted within the fill opening. When mounted, the plug prevents liquid within the fluid dispenser from escaping through the fill opening.

13 Claims, 10 Drawing Sheets

HAND-HELD BODY WASHING DEVICE

RELATED APPLICATIONS

The present application is a continuation-in-part of application Ser. No. 10/074,164 filed Feb. 12, 2002, now abandoned which is a divisional of parent application Ser. No. 09/800,950 filed Mar. 7, 2001, issued as U.S. Pat. No. 6,368,003.

BACKGROUND OF THE INVENTION

The present invention is directed to a hand-held washing device and, more particularly, a washing device constructed of elongated material folded into a plurality of pleats containing a fluid dispenser containing liquid soap and the like.

A variety of hand-held washing devices are available such as scrub brushes, sponges, and the like. These require that soap be separately applied prior to using the device. After the soap is applied, the device is used for scrubbing or otherwise distributing the soap along a user's body. This is inconvenient as it either requires the user to hold the soap in one hand and the device in the other, or requires the user to repeatedly pick up and set down the device and soap as needed.

Some designs feature integrated soap contained within the device. However, these designs are difficult for the user as the soap either cannot be refilled or is difficult to replenish once depleted. Designs that cannot be refilled are obviously not effective after they are extinguished and must be replaced by a new device. Designs that are difficult to refill may not be favored by users. Refilling of these devices is often difficult because the soap is located in the device interior that is difficult to access. Conversely, some designs feature the soap on the device exterior which is easy to access, but may result in the soap repeatedly falling out of the device, or scratching the user during use such as when the soap is contained within a fluid dispenser.

The device should further be designed such that the soap is not damaged or discharged when not in use. By way of example, the bar of soap stored within a wet device will become soft and fall apart during a subsequent washing. Fluid dispensers should be able to contain the washing liquid such that it does not leak or discharge when the device is not in use.

It is also advantageous that the device be aesthetically pleasing. Washrooms and bathrooms are often fancifully decorated and users do not want to put an unattractive object within the environment. It is advantageous if the device itself can further add to the aesthetic qualities of the room.

SUMMARY OF THE INVENTION

The present invention relates to a washing device. The washing device comprises a scrubber and a fluid dispenser disposed within and at least partially surrounded by the scrubber for dispensing a fluid onto the scrubber. The fluid dispenser includes a discharge outlet and a fill opening. A removable plug sized to fit within the fill opening retains the fluid within the fluid dispenser.

In one embodiment, the scrubber is made of a foraminous sheet material, such as a nylon mesh, gathered to form a pleated ball. A cinch binds the sheet material and extends around at least a portion of the fluid dispenser to secure the fluid dispenser within the scrubber.

DETAILED DESCRIPTION OF THE INVENTION

Figure 1:
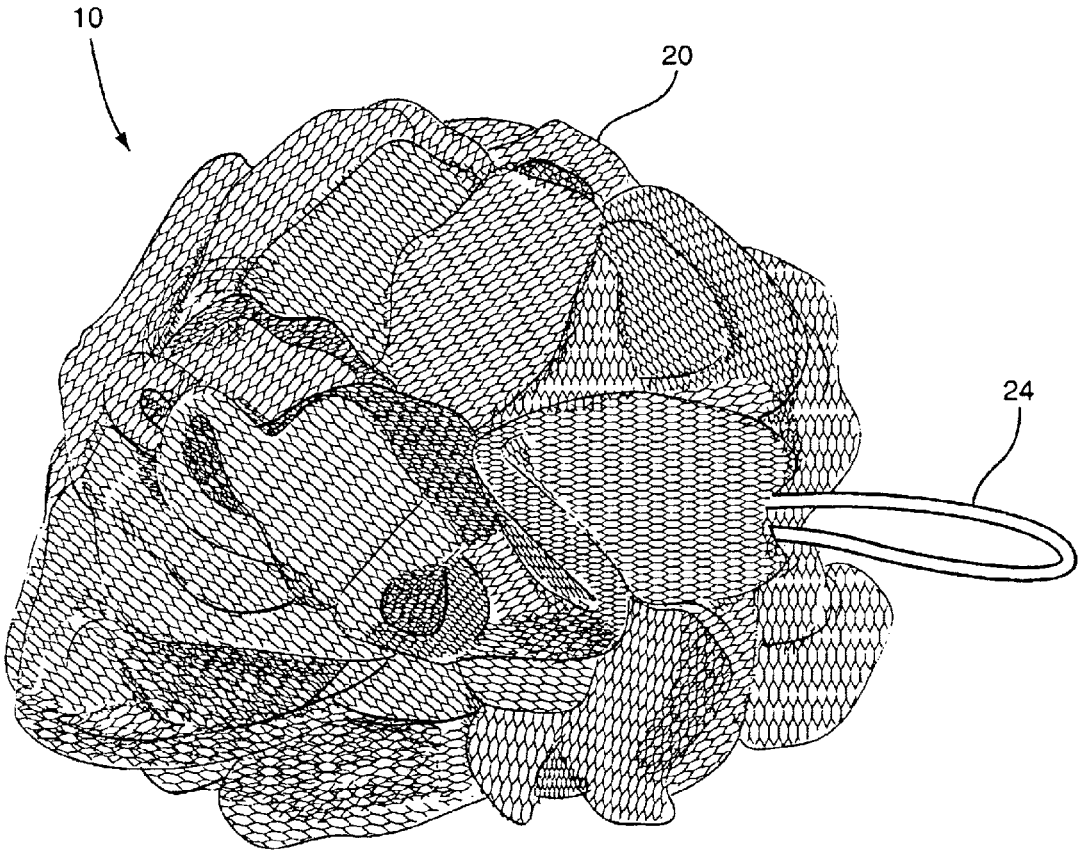
FIG. 1 is a perspective view of one embodiment of the present invention.

The present invention is a hand-held washing device, illustrated generally as 10 in FIG. 1, that contains soap within the interior. The device 10 includes a scrubber 20 made of an elongated mesh material gathered together to form a plurality of pleats. A cinch 30 extends around and holds the pleats together, forming a pleated ball. The soap may be in a variety of forms including a bar 42 and a fluid dispenser 44 comprising a nozzle 46 and a reservoir 48.

The washing device 10 is preferably constructed from an elongated mesh material. Mesh provides some abrasive characteristics when the user rubs the device 10 against the skin to aid in the washing process. Mesh may also dry quicker than a woven or knit material to prevent bacteria from forming within the material between uses. Additionally, mesh allows air to move through the device to dry the soap bar 42 contained within the embodiment illustrated in FIG. 2. The mesh may further be non-absorbent. In one embodiment, the mesh is constructed of tubular nylon, but other natural or synthetic materials may be used.

In another embodiment, washing device 10 is constructed of a plurality of different elongated materials. The materials are folded together forming pleats having either one or both materials and being secured together by the cinch 30. The different materials may allow for different aesthetic appearances, such as each material being of a different color. Each material may further have a different texture to aid in the washing process and increase the comfort and feel to the user.

Figure 2:
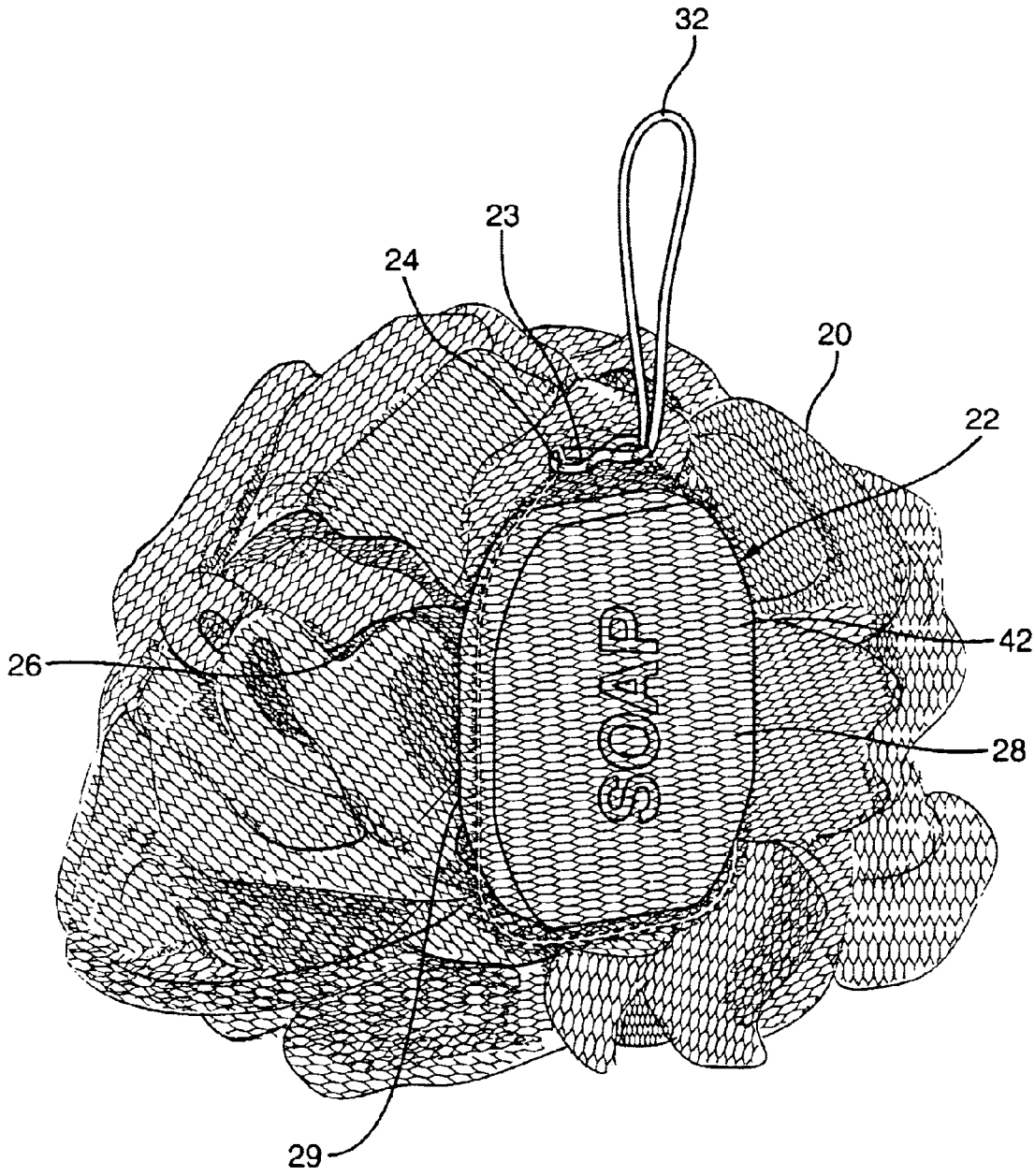
FIG. 2 is a cut-away perspective view of one embodiment of the device illustrating a bar of soap contained within a soap pocket.

FIG. 2 illustrates an embodiment with a bar of soap 42 positioned within the pleats. A soap pocket 22 is formed to contain the soap bar 42 within the interior of the pleats. An opening 23 is positioned within the soap pocket 22 for inserting the soap bar 42. A drawstring 24 may be provided for closing and securing the opening 23. In the embodiment illustrated in FIG. 2, drawstring 24 is sized to extend beyond the pleats to form a handle 32 for the user. Handle 32 may be an extension of the drawstring 24, an extension of the cinch 30, or may be a separate piece. In one embodiment, seams 26 form the soap pocket 22 and contain the soap 42. Soap pocket 22 may be formed from the same piece of material as the washing device 10, or may be a separate material positioned within the interior of the device 10.

Figure 3A:
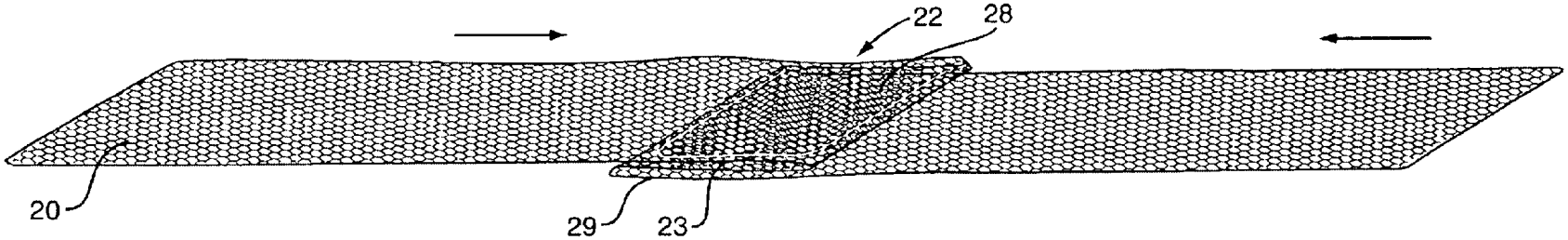
FIG. 3A is a perspective view illustrating the step of forming the soap pocket within a central area of the elongated material.
Figure 3B:
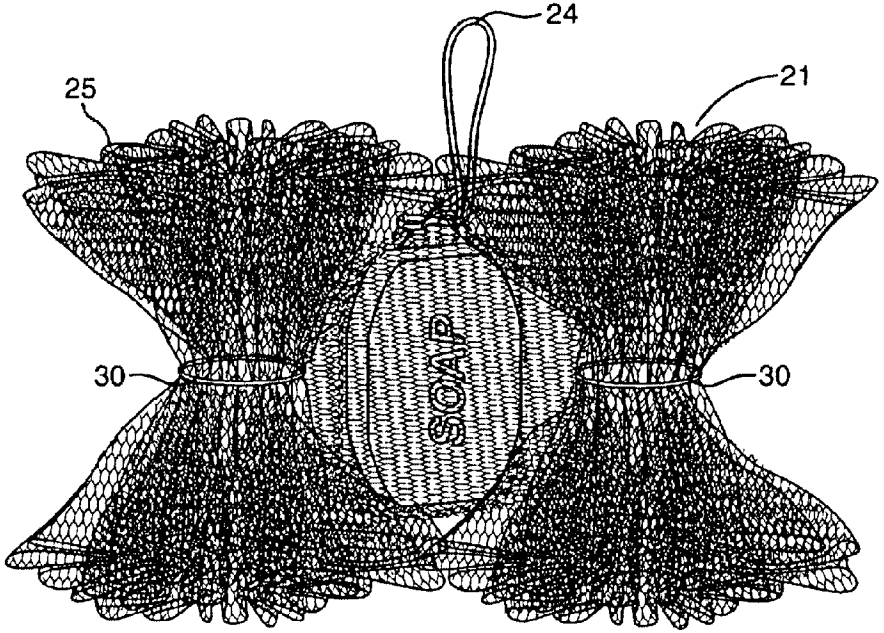
FIG. 3B is a perspective view illustrating pleats bundled on each side of the soap pocket.

FIGS. 3A and 3B illustrate a method of making the washing device 10. A sheet material is folded in half, or may be a single layer with the soap pocket formed within a central section. In the embodiment illustrated in FIG. 3A, the soap pocket 22 is created by folding the sheet material forming front 28 and back 29 panels. A seam 26 may connect the panels and include an opening 23 through which the bar of soap 42 is inserted. The sheet material on each side of the soap pocket 22 is then gathered together in the direction indicated by the arrows forming a plurality of pleats 21, 25 as illustrated in FIG. 3B. Cinches 30 secure the pleat sections 21, 25 together. The sections 21, 25 are then attached to the soap pocket 22 in a manner in which the opening 23 is positioned within the pleats but accessible by the user. A drawstring 24 may be inserted around the opening 23 to selectively open and close the soap pocket 22. Drawstring 24 may extend to provide a handle for the user. The pleats 21, 25 then fall around the cinches 31, 39 and obscure the soap pocket 22 such as illustrated in FIG. 1.

Figure 4:
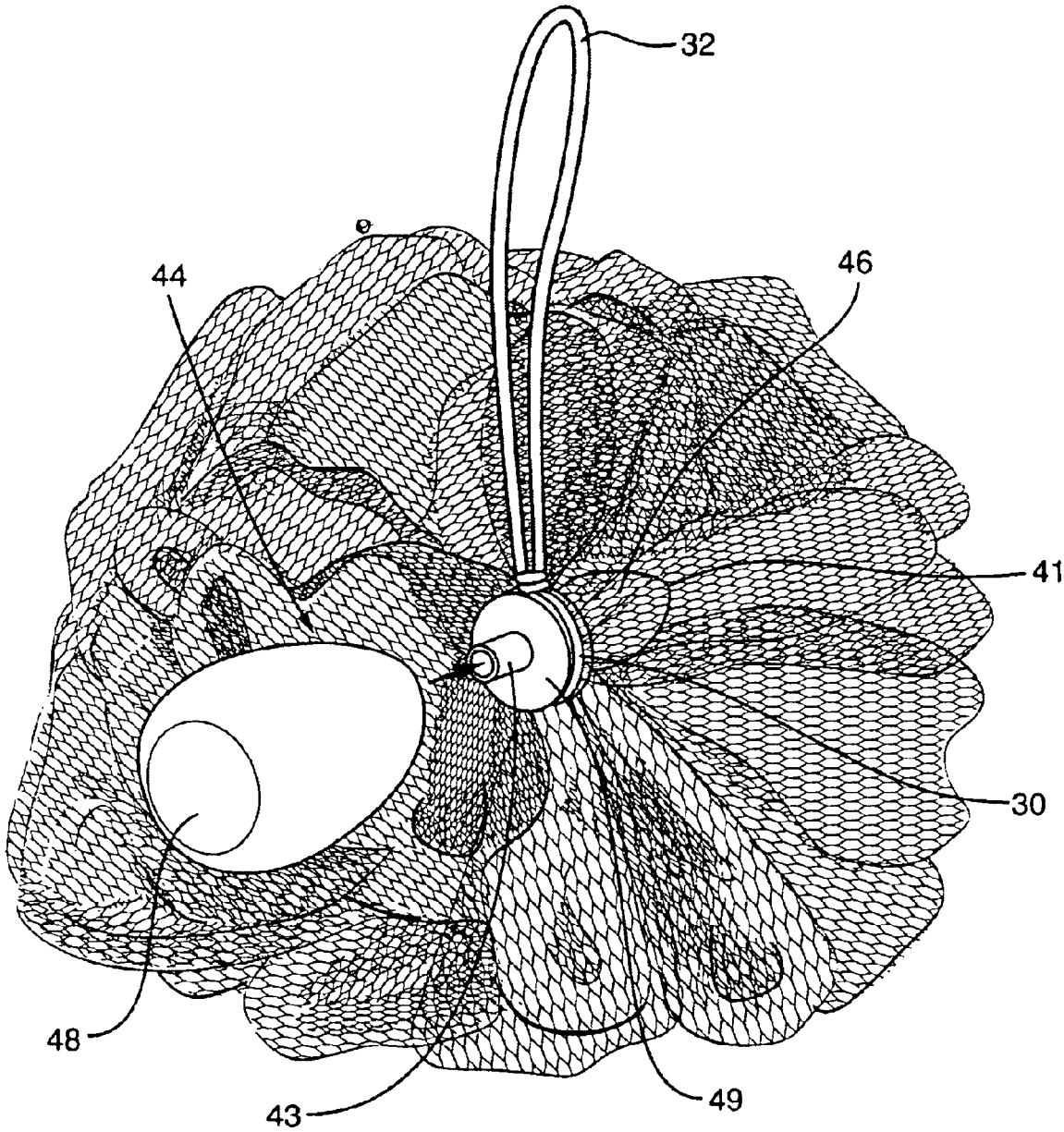
FIG. 4 is a cut-away perspective view of another embodiment having a fluid dispenser contained within the pleats.

FIG. 4 illustrates another embodiment in which a fluid dispenser 44, which can act as a handle, is positioned within the pleats of the scrubber 20 for holding and dispensing a liquid, such as soap, perfume, and the like. The fluid dispenser 44 comprises a detachable nozzle 46 and a reservoir 48. The nozzle 46 includes an outlet 41 having an aperture through which the liquid is emitted and a neck 43. In one embodiment, reservoir 48 is a flexible bulb that is squeezed to force the liquid out through the outlet 41. An opening (not illustrated) within the reservoir 48 is sized to mate with the neck 43. When the liquid is extinguished, the user separates the reservoir 48 from the nozzle, refills it with liquid, and then reattaches the reservoir 48 to the neck 43.

A cinch 30 extends around and holds together the pleats and nozzle 46. Cinch 30 may have a variety of lengths depending upon the size of the pleats and nozzle 46. In one embodiment, cinch 30 comprises a string that extends around and is tied to contain the pleats and nozzle 46. In another embodiment, cinch 30 is an elastic band that is stretched to extend around the pleats and nozzle 46 and then released to contain the pleats. The cinch may also comprise a metal band. The pleats conceal the cinch 30 and nozzle 46 such that it is not visible to a user as illustrated in FIG. 1. Additionally, cinch 30 and nozzle 46 do not directly contact the user when bathing with the device 10 as it may be abrasive or otherwise uncomfortable to the user. Nozzle 46 may further include flanges 49 which define an annular channel for maintaining the cinch 30.

Figure 5:
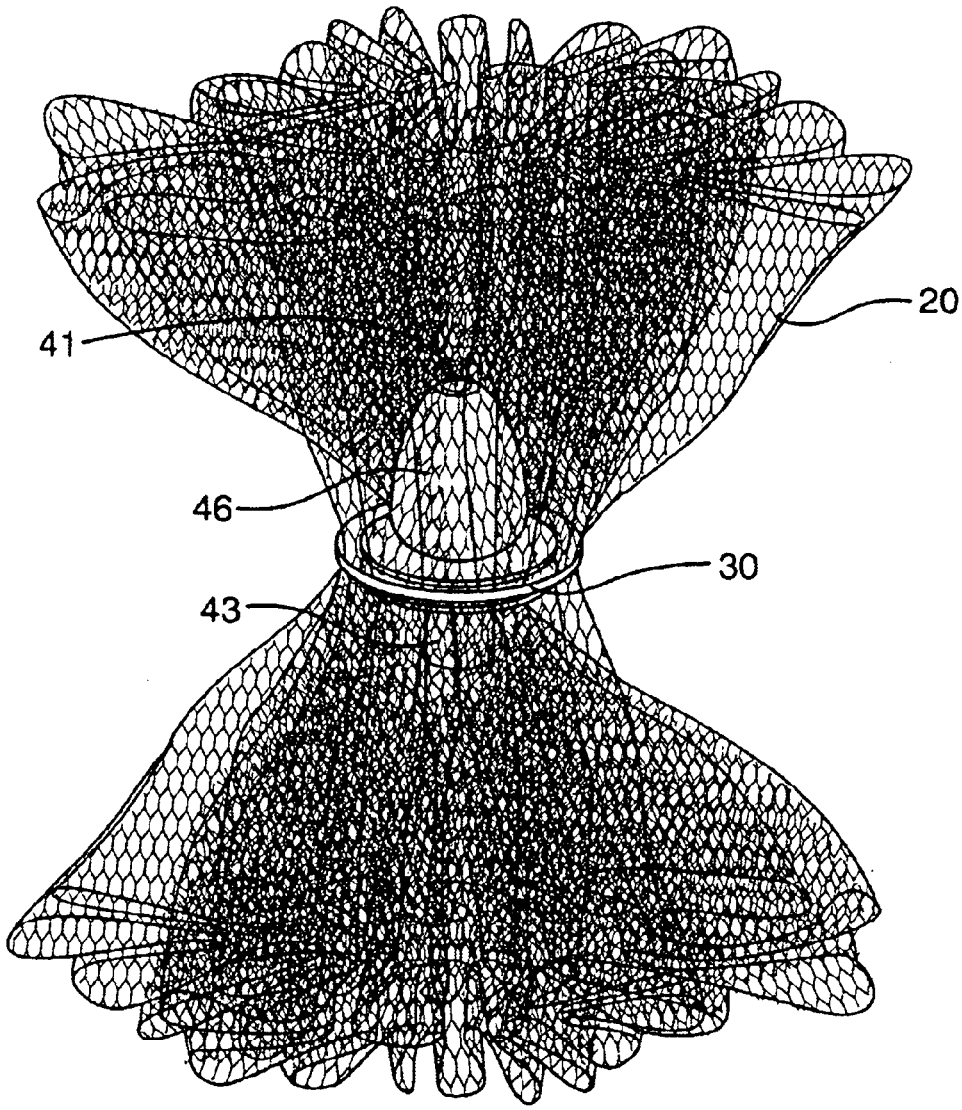
FIG. 5 is a perspective view illustrating the nozzle being secured by the cinch and being positioned within the material.

FIG. 5 illustrates the fluid dispenser embodiment being constructed. The sheet material is bundled together forming pleats and the cinch 30 is secured around a middle section of the pleats. The nozzle 46 is then inserted within a loop formed by the cinch 30 such that the outlet 41 extends on a first side of the cinch 30, and the neck 43 extends outward from a second side. The neck 43 extends outward such that the reservoir 48 may be attached. Neck 43 may be flared on the end to provide a secure seal. When the pleats are released, they fall to cover the cinch 30 and nozzle 46.

In preferred embodiments, the soap bar 42 and the fluid dispenser 44 are visibly obscured by the pleats. Additionally, in preferred embodiments, the user does not see nor directly touch the soap. This adds to the comfort of using the device 10, and also aids in the aesthetic appearance.

Figure 6:
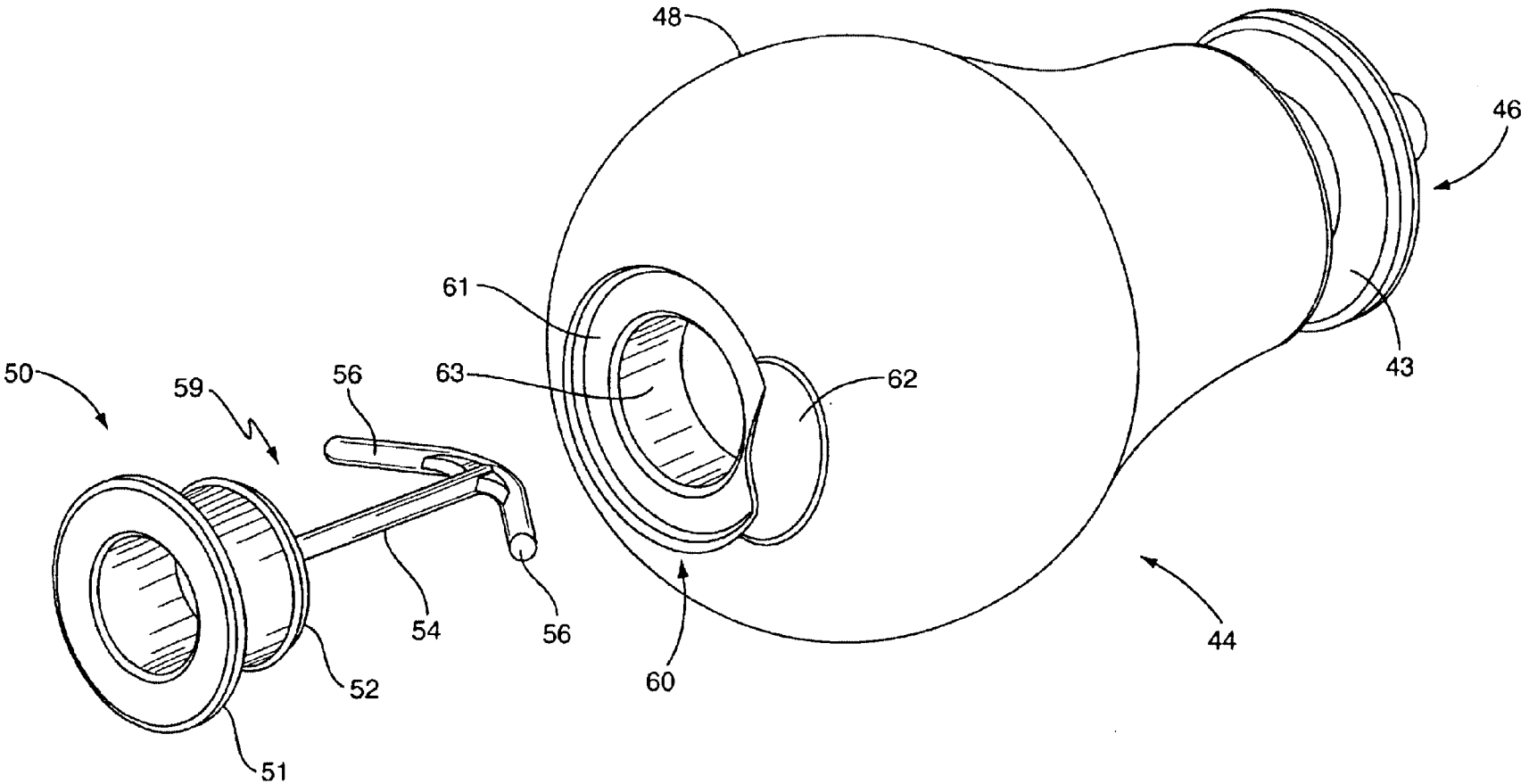
FIG. 6 is a perspective view of a fluid dispenser containing a fill opening and a plug that is inserted into the fill opening constructed according to one embodiment of the present invention.
Figure 7:
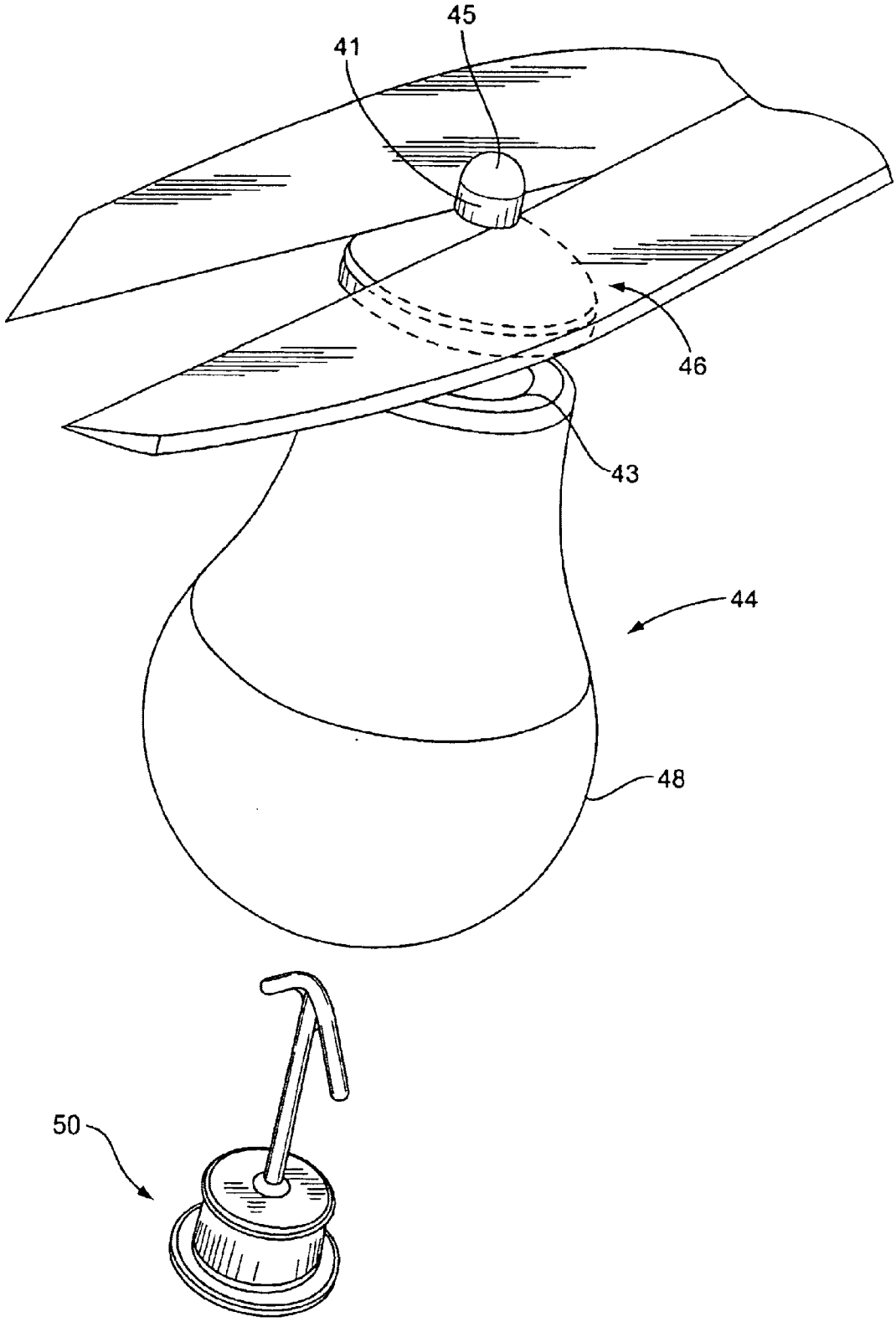
FIG. 7 is a perspective view of a fluid dispenser illustrating a method of forming an outlet within the dispenser according to one embodiment of the invention.

FIG. 6 illustrates an alternative design of the fluid dispenser 44. The fluid dispenser in FIG. 6 has an integral nozzle 46 and fluid reservoir 48. The nozzle 46 and fluid reservoir 48 may be constructed of a different materials. For example, the fluid dispenser may be rubber while the nozzle is plastic. A neck portion 43 separates the nozzle 46 from the fluid reservoir 48. The nozzle 46 includes a nipple 45 which serves as a fluid outlet 41 when the tip of the nipple 45 is cut as shown in FIG. 7. Fluid is discharged from the fluid dispenser 44 by squeezing the fluid reservoir 48 thereby forcing fluid out through the outlet 41. The fluid dispenser 44 could include a discharge assistant, such as a manual pump, to discharge fluid out through the outlet 41.

The fluid reservoir 48 in the embodiment of FIG. 6 includes a fill opening 60 with a removable plug 50. Plug 50 is sized to fit within the fill opening 60 to contain the fluid within the fluid dispenser 44 without leaking. Plug 50 can be removed from the fill opening 60 to fill the fluid dispenser 44. Fill opening 60 can have a variety of shapes and sizes depending upon the specific application. Fill opening 60 can be located at a variety of positions on the fluid dispenser 44. In one embodiment, fill opening 60 is positioned on the rear of the fluid dispenser 44 opposite the nozzle 46.

The fill opening 60 may be recessed to from a seat 61 surrounding the fill opening 60. The recessed seat 61 extends around at least a portion of the fill opening 60. Recessed seat 61 has a depth and size to mate with an upper seal 51 of the plug 50 to contain liquid within the fluid dispenser 44. The seat 61 is recessed such that the plug 50 is flush with the surface of the fluid dispenser 44 when inserted within the fill opening 60. The fluid dispenser 48 may have a slight depression 62 adjacent the fill opening lip 62 that allows a user to more easily remove the plug 50. More particularly, the depression allows the user to grasp the edge of the upper seal 51 of the plug 50 and remove the plug 50 from the fill opening 60.

Plug 50 may have a variety of shapes and sizes depending upon the size and shape of the fill opening 60. In the embodiment illustrated in FIG. 6, plug 50 includes an upper seal 51 and an inner seal 52. The upper seal 51 comprises a flange that engages the recessed seat 61. The inner seal 52 engages the inner wall 63 of the fill opening 60.

The plug 50 may further include an retainer 59 to loosely connect the plug 50 to the fluid dispenser 44. In one embodiment, retainer 59 includes an elongated stem 54 integrally formed with the body of the plug 50 and a pair of laterally projecting arms 56 projecting outwardly from the stem 54. The span of the arms 56 is greater than the diameter of the fill opening 60 so that the arms 56 prevent the plug 56 from being separated from the fluid dispenser 44 when it is removed to refill the fluid dispenser 44. The stem 54 is long enough such that the plug 50 does not interfere with the fill opening 60 during filling.

Figure 8:
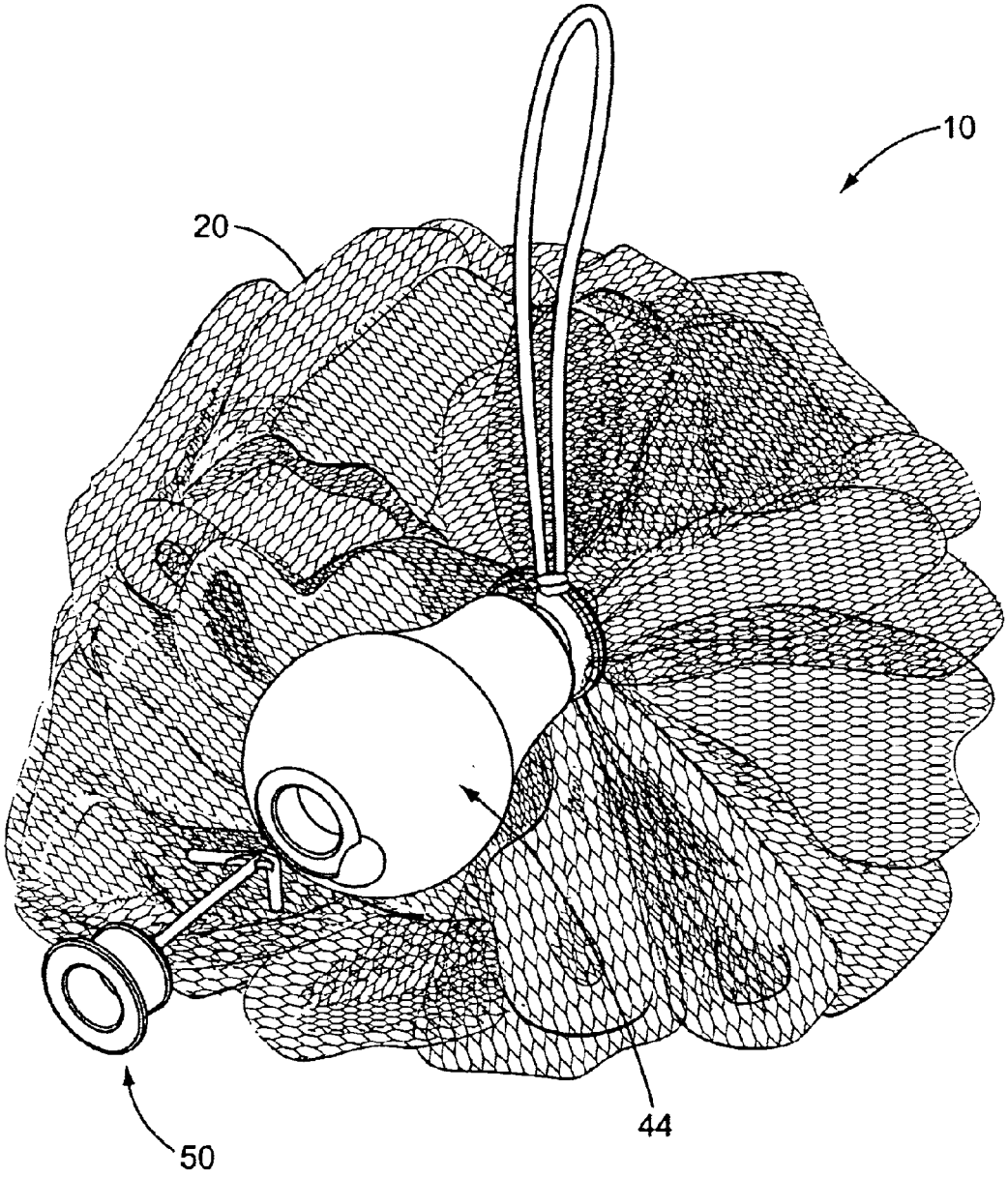
FIG. 8 is a cut-away perspective view of another embodiment having a fluid dispenser contained within the pleats and a plug to seal the dispenser.

FIG. 8 is a perspective view illustrating the fluid dispenser 44 positioned within the pleats of the washing device 10. In one embodiment, the fluid dispenser 44 is located within the washing device 10 so as to be at least partially surrounded by the elongated mesh material 20. The fluid dispenser 44 is secured within the pleats of the washing device by a cinch 30 as previously described. The elongated mesh material 20 may be parted by the user if necessary to gain access to the fill opening 60 of the fluid dispenser 44. The user may then remove the plug 50 from the fill opening 60 to refill the fluid dispenser 44. Thus, the user can refill the fluid dispenser 44 without the need to remove the fluid dispenser 44 or fluid reservoir 48 from the pleats of the washing device 10.

Figure 9:
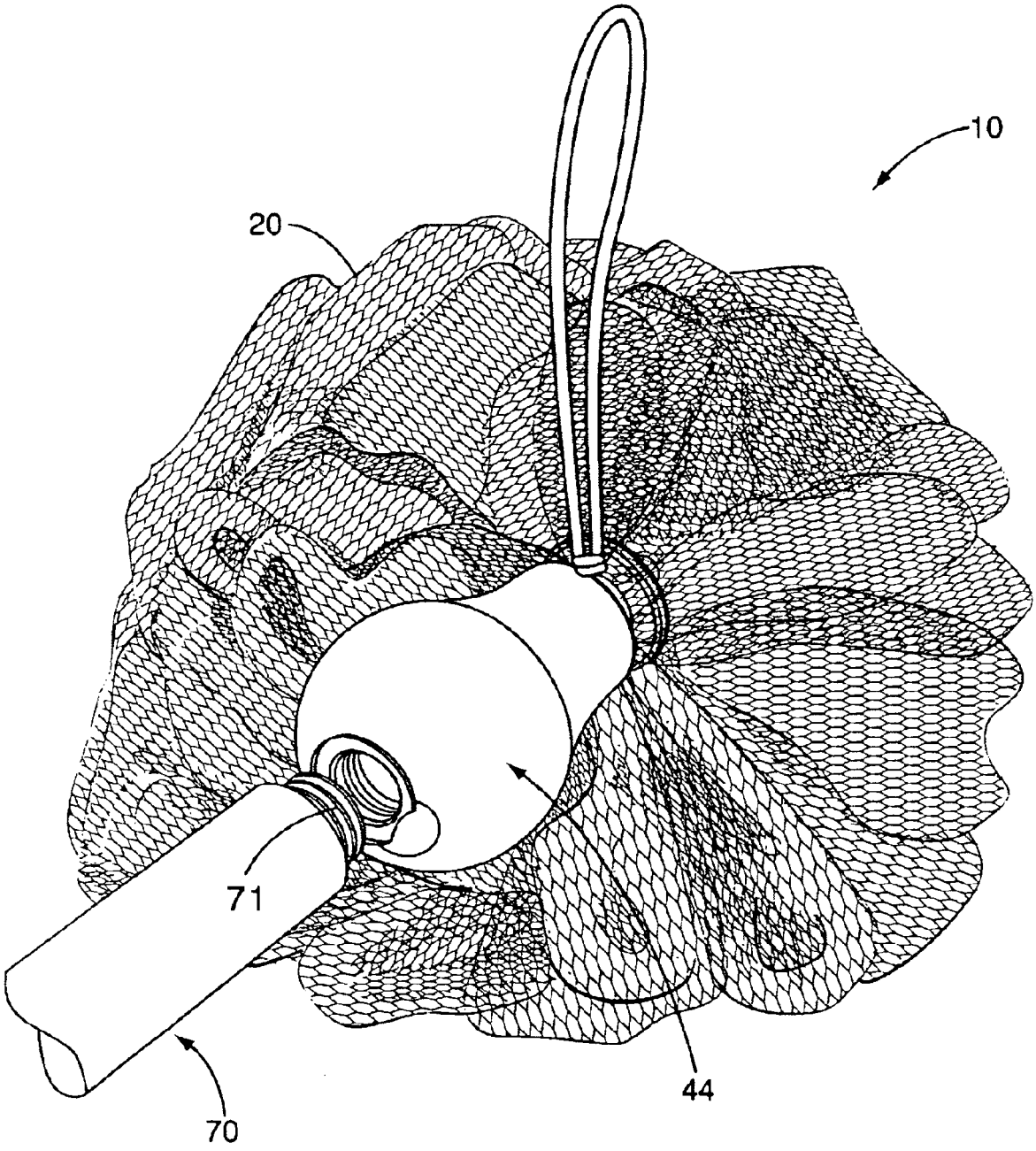
FIG. 9 is a cut-away perspective view of another embodiment having a fluid dispenser contained within the pleats and a handle insertable into the dispenser fill opening.

FIG. 9 illustrates another embodiment in which the fill opening 60 of the fluid dispenser 44 is internally threaded for attaching to a threaded end 71 of a handle 70. The handle 70 may have a variety of lengths, and enables the user to access parts of the body with the washing device 10 that may not be reached by hand. In one example, handle 70 is of a length such that the user can wash their back. In one embodiment as illustrated, the inner wall 63 is threaded to mate with the threaded end 71 to provide a watertight seal to prevent leakage of the liquid. In another embodiment, handle 70 is the length of the inner wall 63 of the fill opening 60 such that a top surface of the handle 70 is flush with a surface of the fluid dispenser 44 when threaded into the fill opening 60.

Figure 10:
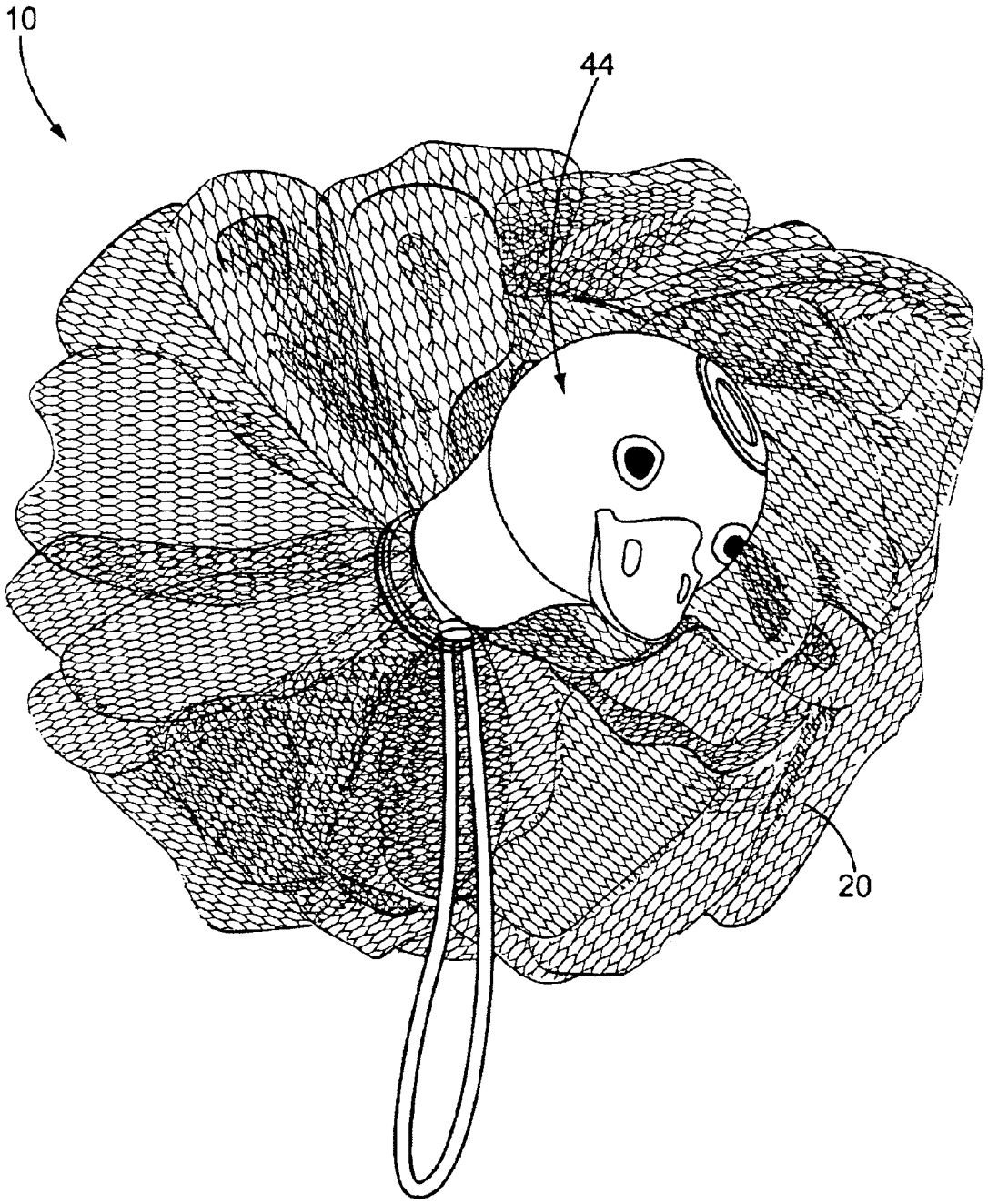
FIG. 10 is a cut-away perspective view of another embodiment having an aesthetically pleasing fluid dispenser.

FIG. 10 illustrates another embodiment in which a fluid dispenser 44 is given an aesthetically pleasing shape. The fill opening 60 is positioned on the fluid dispenser 44 so that it does not detract from the aesthetics, or so that it is compatible with the aesthetics of the fluid reservoir 46. In one embodiment as illustrated, fill opening 60 forms a portion of the head of a duck.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A washing device comprising:

a) a scrubber made of a foraminous sheet material gathered to form a pleated ball;

b) a fluid dispenser disposed within and at least partially surrounded by the pleats of the scrubber for dispensing a fluid onto the scrubber;

c) a cinch for binding the sheet material to form said pleated ball, said cinch extending around a portion of the fluid dispenser to secure the fluid dispenser within the scrubber.

2. The washing device of claim 1 wherein the fluid dispenser includes a discharge outlet and a fill opening.

3. The washing device of claim 1 wherein the fluid dispenser further includes a removable plug sized to fit within the fill opening to retain the fluid within the fluid dispenser.

4. The washing device of claim 3 further comprising a recessed seat extending around a section of the fill opening and wherein the plug includes a first seal that engages the recessed seat.

5. The washing device of claim 4 wherein the plug includes a second seal that engages an inner surface of the fill opening.

6. The washing device of claim 3 wherein the plug includes a retainer to connect the plug and the fluid dispenser.

7. The washing device of claim 1 wherein the scrubber is formed from a sheet material gathered to form a plurality of pleats.

8. The washing device of claim 1 wherein the scrubber is made of a mesh material.

9. The washing device of claim 1 wherein the fluid dispenser is made of rubber and the outlet is made of plastic.

10. The washing device of claim 1 wherein the dispenser has an aesthetically pleasing shape.

11. A washing device comprising:

a scrubber made of a foraminous material and gathered to form a pleated ball;

a figurative handle coupled to the scrubber; and a cinch for binding the foraminous material into the pleated ball and forming a loop extending around at least a portion of said handle to secure the handle to the scrubber.

12. The washing device of claim 11 wherein the handle forms the head of a duck.

13. The washing device according to claim 11 wherein said handle includes a annular channel and wherein said loop is disposed within said annular channel of said handle.

* * * * *